US008836741B2

(12) United States Patent
Arima

(10) Patent No.: US 8,836,741 B2
(45) Date of Patent: Sep. 16, 2014

(54) IMAGE FORMING APPARATUS

(71) Applicants: Kabushiki Kaisha Toshiba, Tokyo (JP); Toshiba Tec Kabushiki Kaisha, Tokyo (JP)

(72) Inventor: Yasuharu Arima, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/054,146

(22) Filed: Oct. 15, 2013

(65) Prior Publication Data

US 2014/0192124 A1 Jul. 10, 2014

(51) Int. Cl.

| | |
|---|---|
| ***B41J 29/00*** | (2006.01) |
| ***B41J 11/00*** | (2006.01) |
| *B41M 7/00* | (2006.01) |

(52) U.S. Cl.

CPC ..... *B41J 11/0015* (2013.01); *B41J 11/002* (2013.01); *B41M 7/00* (2013.01); *B41M 7/009* (2013.01)

USPC ..... 347/179

(58) Field of Classification Search

USPC ..... 347/171, 179

See application file for complete search history.

(56) References Cited

U.S. PATENT DOCUMENTS

| | | | | |
|---|---|---|---|---|
| 2011/0065056 | A1 | 3/2011 | Iguchi et al. | |
| 2011/0274445 | A1 * | 11/2011 | Kabai et al. | 399/12 |
| 2012/0025454 | A1 | 2/2012 | Iguchi et al. | |
| 2013/0002784 | A1 | 1/2013 | Iguchi et al. | |

FOREIGN PATENT DOCUMENTS

| | | |
|---|---|---|
| JP | 2011-221222 | 4/2011 |

* cited by examiner

*Primary Examiner* — Huan Tran

(74) *Attorney, Agent, or Firm* — Patterson & Sheridan LLP

(57) ABSTRACT

According to one embodiment, an image forming apparatus having an image forming function to form an image on a recording medium, and an image erasing function to erase an image formed on a recording medium is provided. The image forming apparatus has an erasing unit which erases the image formed on the recording medium under an erasing condition changeable in accordance with whether or not erasable coloring material used in the image formed on the recording medium is predetermined coloring material, when the image erasing function is performed.

10 Claims, 8 Drawing Sheets

IMAGE FORMING APPARATUS

CROSS-REFERENCE TO RELATED APPLICATION

This application is based upon and claims the benefit of priority from the prior Japanese Patent Application No. 2013-002585, filed on Jan. 10, 2013, the entire contents of which are incorporated herein by reference.

FIELD

Embodiments described herein generally relate to an image forming apparatus having a function to erase an image formed on a recording medium.

BACKGROUND

An image forming apparatus having an erasing unit which erases an image printed using erasable coloring material, such as toner and ink, so as to reuse a recording medium used for printing an image, such as a sheet, has been proposed. The erasing unit performs erasing processing under a prescribed erasing condition. The prescribed erasing condition is an erasing condition corresponding to coloring material of a predetermined product, such as a genuine product. Accordingly, when erasable coloring material used in a printed image is coloring material of a non-genuine product for example, even though the erasing unit performs erasing processing, the printed image might not be erased. Coloring material of a genuine product is coloring material which an apparatus maker has certified, for example. Coloring material of a non-genuine product is coloring material except the coloring material of a genuine product.

DETAILED DESCRIPTION

Figure 1:
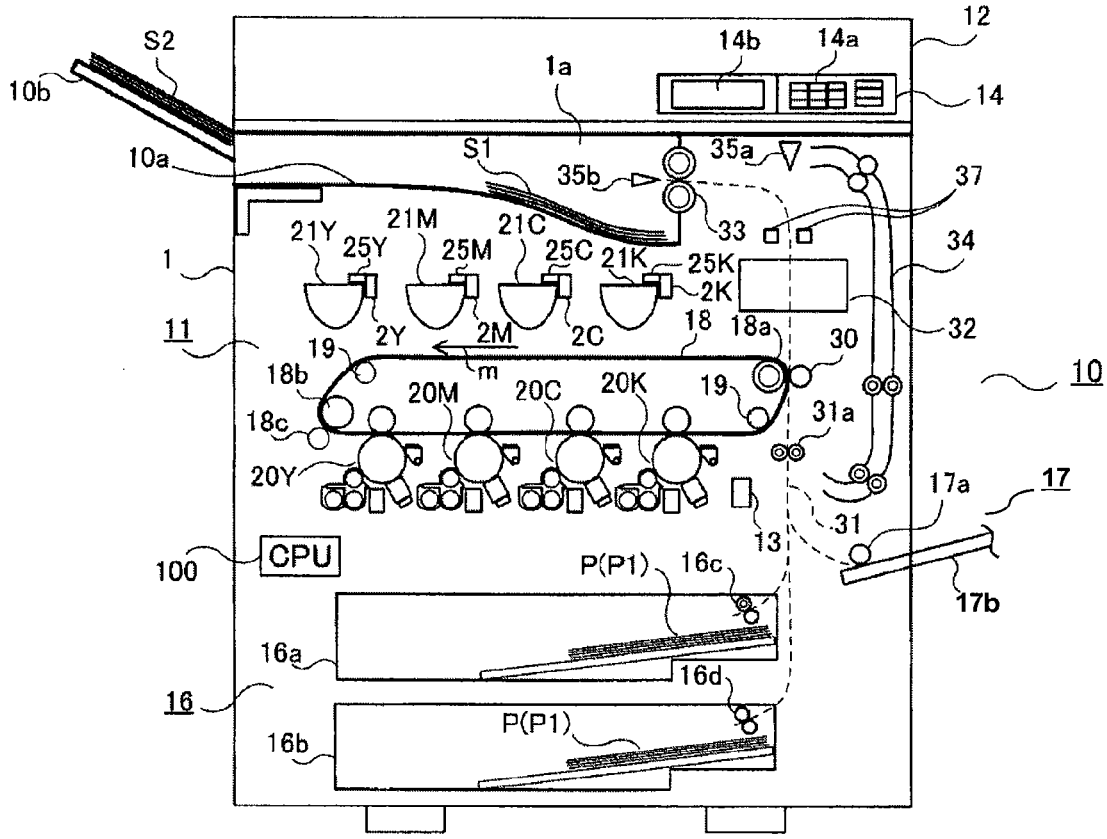
FIG. 1 is a sectional view showing an image forming apparatus according to a first embodiment.

According to one embodiment, an image forming apparatus having an image forming function to form an image on a recording medium, and an image erasing function to erase an image formed on a recording medium, the image forming apparatus is provided. The image forming apparatus has an image forming unit and an erasing unit. The image forming unit forms the image on the recording medium using erasable coloring material, when the image forming function is performed. The erasing unit erases the image formed on the recording medium under an erasing condition changeable in accordance with whether or not erasable coloring material used in the image formed on the recording medium is predetermined coloring material, when the image erasing function is performed.

Hereinafter, further embodiments will be described with reference to the drawings. In the drawings, the same symbols show the same or similar portions.

A first embodiment will be described with reference to FIG. 1 to FIG. 5. FIG. 1 is a sectional view showing an image forming apparatus according to a first embodiment. An image forming apparatus 10 of the first embodiment is an MFP (Multi-Function Peripheral) having a print function to print a color image on a recording medium, such as a sheet, and a copy function, using an electrophotographic system, for example. The image forming apparatus 10 has further an erasing function to erase an image printed on a sheet, a scan function, and so on. As shown in FIG. 1, the image forming apparatus 10 has a CPU (Central Processing Unit) 100 that is a control unit to control the whole apparatus. The image forming apparatus 10 has a printer unit 11 within an apparatus chassis 1. The image forming apparatus has a sheet discharge tray 1*a* surrounded with walls of the apparatus chassis 1. The printer unit 11 has a heating unit 32 which functions as a fixing unit when the image forming apparatus 10 performs the print function or the copy function, and functions as an erasing unit when the image forming apparatus 10 performs the erasing function. Hereinafter, a case in which the image forming apparatus 10 performs the print function or the copy function is called a print mode, and a case in which the image forming apparatus 10 performs the erasing function is called an erasing mode. The image forming apparatus 10 prints an image on a sheet P in the print mode, and erases an image on a printed sheet P1 in the erasing mode.

As shown in FIG. 1, the image forming apparatus 10 has a scanner unit 12 above the printer unit 11 in the drawing, and an operation panel 14 that is an operation unit at the front side. The operation panel 14 has a key board 14*a* which accepts a user's input and so on, for example, and a display 14*b* of a touch panel type which accepts a user's input and so on and displays guide and so on for a user.

The image forming apparatus 10 has a sheet feeding unit 16 and a manual unit 17 below the printer unit 11 in the drawing. The sheet feeding unit 16 has a first sheet feeding cassette 16*a* and a second sheet feeding cassette 16*b* as a sheet housing portion for housing a sheet. The sheet feeding unit 16 has a first pickup roller 16*c* and a second pickup roller 16*d* which take out sheets from the first sheet feeding cassette 16*a* and the second sheet feeding cassette 16*b*, respectively. The manual unit 17 has a manual sheet feeding tray 17*b* as a sheet housing portion for housing a sheet. The manual unit 17 has a pickup roller 17*a* which takes out a sheet from the manual sheet feeding tray 17*b*. The first sheet feeding cassette 16*a*, the second sheet feeding cassette 16*b* or the manual sheet feeding tray 17*b* houses an unused sheet P or a reuse sheet P to be supplied to the printer unit 11. The reuse sheet P is a sheet on which a printed image has been erased by erasing processing, for example. The first sheet feeding cassette 16*a*, the second sheet feeding cassette 16*b* or the manual sheet feeding tray 17*b* houses a printed sheet P1, that is a sheet P1 of an image erasing processing target, so as to feed the printed sheet P1 to the heating unit 32.

In what sheet housing portion out of the sheet feeding cassettes 16*a*, 16*b* and the manual sheet feeding tray 17*b*, an unused sheet P or a reuse sheet P is housed, and in what sheet housing portion out of the sheet feeding cassettes 16*a*, 16*b* and the manual sheet feeding tray 17*b*, a printed sheet P1 is housed, are selected by a user. Specifically, in the print mode, the user houses an unused sheet P or a reuse sheet P in at least one sheet housing portion out of the sheet feeding cassettes 16*a*, 16*b* and the manual sheet feeding tray 17*b*. The user selects the sheet housing portion which has housed the sheet P, and instructs a start of the print mode on the operation panel 14. When the operation panel 14 accepts the selection of the sheet housing portion and the start instruction of the print mode by the user, the pickup rollers 16*c*, 16*d* or the pickup roller 17*a* takes out the sheet P from the selected sheet housing portion. In addition, in the erasing mode, the user houses a printed sheet P1 in at least one sheet housing portion out of the sheet feeding cassettes 16*a*, 16*b* and the manual sheet feeding tray 17*b*. The user selects the sheet housing portion which has housed the sheet P1, and instructs a start of the erasing mode on the operation panel 14. When the operation panel 14 accepts the selection of the sheet housing portion and the start instruction of the print mode by the user, the pickup rollers 16*c*, 16*d* or the pickup roller 17*a* takes out the sheet P1 from the selected sheet housing portion.

The image forming apparatus 10 has a conveying unit which conveys the sheet taken out from the sheet feeding cassettes 16*a*, 16*b* or the manual sheet feeding tray 17*b* to a sheet discharge tray 10*a* or a reject tray 10*b* through the position of a secondary transfer roller 30 described later and the heating unit 32. The conveying unit has a pair of resist rollers 31*a*, branch guide members 35*a*, 35*b*, a pair of sheet discharge rollers 33, a conveying path 31, and a re-conveying unit 34. The conveying unit conveys a sheet in cooperation with an intermediate transfer belt 18, the secondary transfer roller 30, and the heating unit 32.

The printer unit 11 has the intermediate transfer belt 18 which rotates in the direction of an arrow m. The printer unit 11 has four image forming units 20Y, 20M, 20C and 20K which are arranged in parallel along the lower side of the intermediate transfer belt 18 in the drawing, and form images of respective colors of Y (yellow), M (magenta), C (cyan), and K (black). The printer unit 11 has cartridges 21Y, 21M, 21C and 21K above the respective image forming units 20Y, 20M, 20C and 20K in the drawing, as housing units which house toners, so as to replenish erasable toners that are erasable coloring materials to the respective image forming units 20Y, 20M, 20C and 20K. Hereinafter, the image forming units 20Y, 20M, 20C and 20K are simply called an image forming unit 20 sometimes, and the cartridges 21Y, 21M, 21C and 21K are simply called a cartridge 21 sometimes.

The image forming unit 10 has a mounting portion on which the cartridge 21 is mounted. The mounting portion detachably supports the mounted cartridge 21. When toner in the cartridge 21 runs out, for example, a user can take out the cartridge 21 mounted on the mounting portion, and exchanges it for another cartridge, such as a new cartridge.

The cartridges 21Y, 21M, 21C and 21K house erasable toners of Y (yellow), M (magenta), C (cyan), K (black) as erasable coloring materials, respectively. When erasable toner is heated at a prescribed temperature (hereinafter, called an erasing temperature) that is an erasing condition, the color is erased. Erasable toner includes coloring agent, color developing compound and color developer in binder resin, for example. When an image formed using erasable toner is heated at the erasing temperature, the color developing compound and the color developer in the erasable toner dissociate, and the color of the toner is erased. Erasable toner can be fixed at a fixing temperature that is comparatively lower than the erasing temperature. The erasing temperature is a temperature higher than the fixing temperature by about 10° C., for example.

If binder resin, coloring agent, color developing compound and color developer and so on are different in erasable toners, erasing characteristics thereof are different. With respect to erasable toner, erasable toner of a genuine product, that is coloring material of a genuine product, and erasable toner of a non-genuine product, that is coloring material of a non-genuine product are different in erasing characteristics. Accordingly, erasable toner of a genuine product, and erasable toner of a non-genuine product are sometimes different in erasing temperature, that is the erasing characteristics. The erasing temperature is a heating temperature required for erasing the color of erasable toner.

The cartridges 21 have portions 25Y, 25M, 25C and 25K to be detected outside the containers, for example, so as to authenticate that they are predetermined products, respectively. Hereinafter, the portions 25Y, 25M, 25C and 25K to be detected are simply called a portion 25 to be detected sometimes. The above-described predetermined product is a product which is certified by a maker of the image forming apparatus 10, for example. Hereinafter, a product certified by the maker of the image forming apparatus 10 is called a genuine product, and a product except the genuine product is called a non-genuine product. The portion to be detected 25 includes authentication information D1 so as to authenticate that the product is a genuine product. The authentication information D1 is information recorded in the portion to be detected 25 with a bar code, for example.

The image forming apparatus 10 has sensors 2Y, 2M, 2C and 2K to respectively detect the portions to be detected 25Y, 25M, 25C and 25K. Hereinafter, the sensors 2Y, 2M, 2C and 2K are simply called a sensor 2 sometimes. The sensor 2 is provided at a position where the sensor 2 can detect the portion to be detected 25, when the cartridge 21 is mounted on the above-described mounting portion of the image forming apparatus 10. For example, the sensor 2 is provided at a position corresponding to the position of the portion to be detected 25 when the cartridge 21 is mounted on the image forming apparatus 10. The sensor 2 detects the portion to be detected 25, to read the authentication information D1. The CPU 100 of the image forming apparatus 10 judges whether the mounted cartridge 21 is a genuine product or a non-genuine product, based on the detection result of the sensor 2. For example, when the sensor 2 can read the authentication information D1 of the portion to be detected 25, the mounted cartridge 21 is a genuine product. That the mounted cartridge 21 is a genuine product means that the erasable tonner housed in the cartridge 21 is a genuine product, and further means that the erasable toner used in the print mode is a genuine product. For example, when the sensor 2 can not detect the portion to be detected 25, the mounted cartridge 21 is a non-genuine product. Furthermore, when the sensor 2 detects the portion to be detected 25, but can not read the authentication information D1 of the portion to be detected, 25 the mounted cartridge 21 is a non-genuine product. That the mounted cartridge 21 is a non-genuine product means that the erasable tonner housed in the cartridge 21 is a non-genuine product, and further means that the erasable toner used in the print mode is a non-genuine product.

Accordingly, the sensor 2 can detect whether or not the erasable toner used in the print mode is a genuine product. The above-described authentication information D1 is not limited to information recorded with a bar code. For example, the authentication information D1 may be a character or a digit recorded in the portion to be detected 25, for example. The above-described authentication information D1 may be a specific shape structure which the portion to be detected 25 has.

The CPU 100 judges whether or not erasable toner used in an image of a printed sheet P1 is a genuine product, in the erasing mode, based on the authentication information D1 which has been detected and read from the portion to be detected 25 by the sensor 2. Specifically, when the printed sheet P1 is a sheet on which an image has been printed by the image forming apparatus 10, if the cartridge 21 mounted on the image forming apparatus 10 is a genuine product, it is highly likely that the erasable toner used in the image of the printed sheet P1 is a genuine product. If the cartridge 21 mounted on the image forming apparatus 10 is a non-genuine product, it is highly likely that the erasable toner used in the image of the printed sheet P1 is a non-genuine product. Accordingly, when the CPU 100 judges that the cartridge 21 mounted on the image forming apparatus 10 is a genuine product, based on the read authentication information D1, the CPU 100 judges that the erasable toner used in the image of the printed sheet P1 is a genuine product. In addition, when the CPU 100 judges that the cartridge 21 mounted on the image forming apparatus 10 is a non-genuine product, based on the read authentication information D1, the CPU 100 judges that the erasable toner used in the image of the printed sheet P1 is a non-genuine product.

Figure 2:
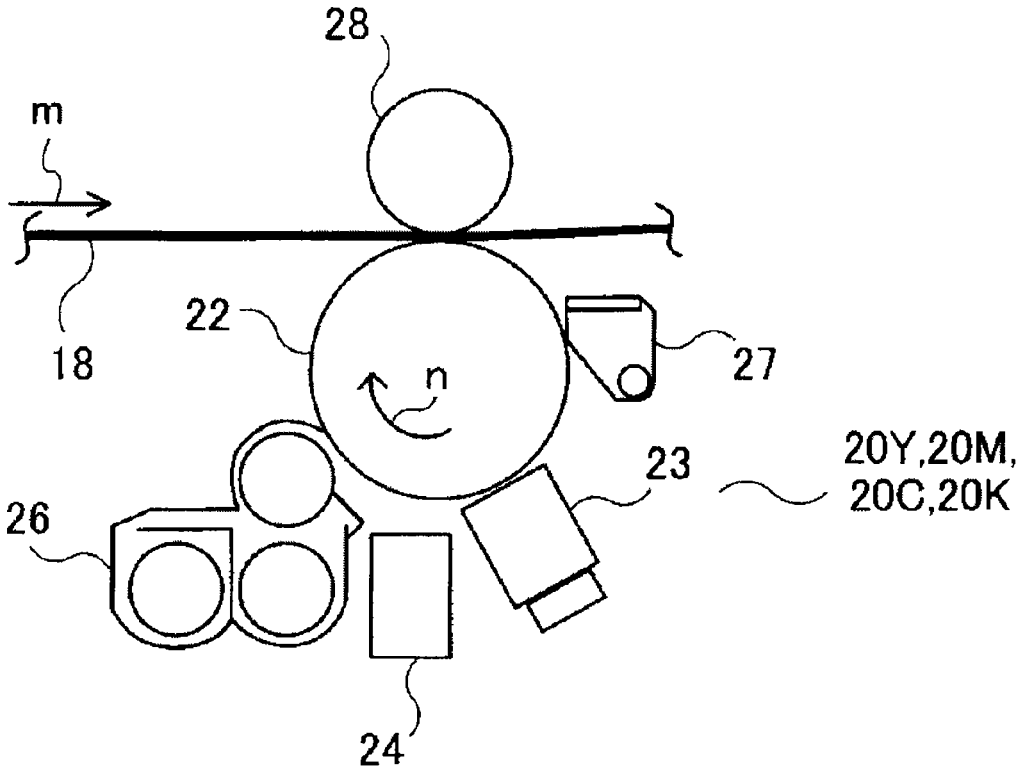
FIG. 2 is a sectional view showing the image forming unit of the image forming apparatus according to the first embodiment.

The four image forming units 20 will be described in detail. The four image forming units 20 operate in the print mode of the image forming apparatus 10. Since the four image forming units 20 have the same configuration, they will be described using the common symbols with reference to FIG. 2. FIG. 2 is a sectional view of the image forming unit 20 of the image forming apparatus 10 according to the first embodiment. As shown in FIG. 2, each of the image forming units 20 has a charger 23, an exposure scanning head 24, a developing device 26, and a photoconductor cleaner 27 around a photoconductor drum 22 which rotates in the direction of an arrow n. The charger 23 uniformly charges the photoconductor drum 22. The exposure scanning head 24 exposes the photoconductor drum 22 which has uniformly been charged by the charger 23, based on the image data obtained by the scanner unit 12, for example, to form an electrostatic latent image on the photoconductor drum 22. The developing device 26 houses developing agent of two components composed of one of erasable toners of Y (yellow), M (magenta), C (cyan), K (black), and a carrier, for example. The developing device 26 supplies the erasable toner which has been charged with a prescribed polarity caused by the friction with the carrier to the photoconductor drum 22, to develop the electrostatic latent image and form a toner image on the photoconductor drum 22.

The image forming apparatus 10 has a primary transfer roller 28 corresponding to each of the image forming units 20. The primary transfer roller 28 faces the photoconductor drum 22 through the intermediate transfer belt 18. The primary transfer roller 28 primarily transfers the toner image formed on the photoconductor drum 22 to the intermediate transfer belt 18. While being supported with a backup roller 18*a*, a driven roller 18*b* and a tension roller 19, the intermediate transfer belt 18 runs in the direction of an arrow m. The primary transfer rollers 28 of the respective image forming units 20 overlap the toner images formed on the photoconductor drums 22 in the order of Y (yellow), M (magenta), C (cyan), K (black), for example, to form a color toner image. The photoconductor cleaner 27 removes the erasable toner remaining on the photoconductor drum 22 after the above-described primary transfer.

The image forming apparatus 10 has the secondary transfer roller 30. The secondary transfer roller 30 is provided at a position facing the backup roller 18*a* in the conveying path 31, and rotates in accordance with the running of the intermediate transfer belt 18. The secondary transfer roller 30 secondarily transfers the color toner image on the intermediate transfer belt 18 to a sheet P. The image forming apparatus 10 has the resist rollers 31*a*, as a conveying unit, in the conveying path 31 at a more upstream position than the secondary transfer roller 30 in the sheet conveying direction. The resist rollers 31*a* are provided in the conveying path 31 which guides the sheet P supplied from the sheet feeding cassettes 16*a*, 16*b* or the manual sheet feeding tray 17 to the position of the secondary transfer roller 30. The resist rollers 31*a* convey the sheet P to the position of the secondary transfer roller 30 while matching the timing of the running of the intermediate transfer belt 18. The image forming apparatus 10 has a belt cleaner 18*c*. The belt cleaner 18*c* removes the erasable toner remaining on the intermediate transfer belt 18 after the secondary transfer.

Figure 3:
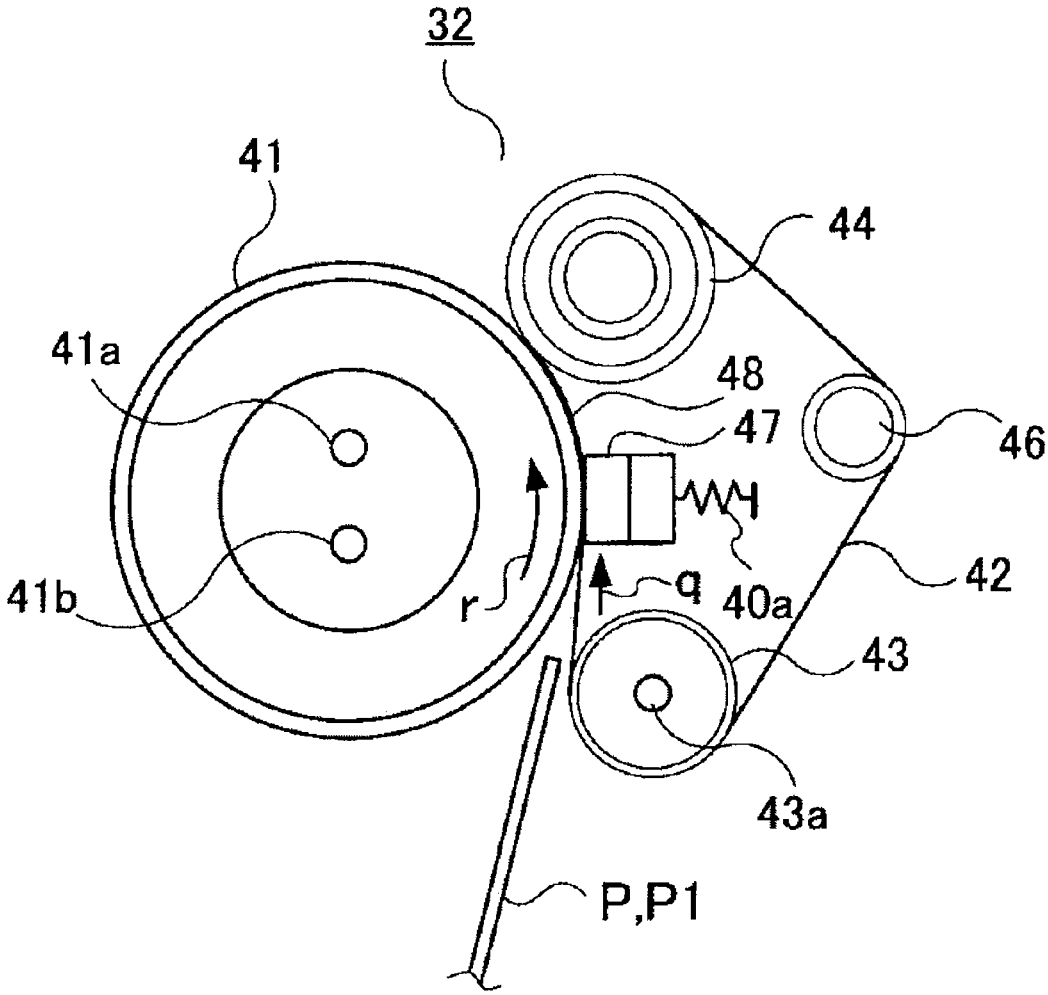
FIG. 3 is a sectional view showing the heating unit of the image forming apparatus according to the first embodiment.

The heating unit 32 is provided at a more downstream position than the secondary transfer roller 30 in the sheet conveying direction along the conveying path 31. FIG. 3 is a sectional view showing the heating unit 32 of the image forming apparatus 10 according to the first embodiment. As shown in FIG. 3, the heating unit 32 has a heat roller 41, a belt heat roller 43, an outlet roller 44, a tension roller 46, a nip pad 47, and a pressure belt 42, for example. The heat roller 41 has two halogen lamps 41*a*, 41*b*, for example. The belt heat roller 43 has a halogen lamp 43*a*. The belt heat roller 43 along with the outlet roller 44 and the tension roller 46 stretch the pressure belt 42. The nip pad 47 is fixed to the inside of the pressure belt 42 through an energizing member 40*a* such as a spring. The nip pad 47 pressurizes the pressure belt 42 to the heat roller 41 side. The nip pad 47 forms a nip 48 between the heat roller 41 and the pressure belt 42.

The heating unit 32 conveys the sheet P with being interposed in the nip 48 between the heat roller 41 which rotates in the direction of an arrow r and the pressure belt 42 which rotates in the direction of an arrow q. The heating unit 32, in the print mode of the image forming apparatus 10, heats the toner image of the sheet P to a fixing temperature and pressurizes it, to fix the toner image on the sheet P. The heating unit 32, in the erasing mode of the image forming apparatus 10, heats the image formed on the printed sheet P1 with erasable toner at an erasing temperature that is an erasing condition. The heating unit 32 heats the erasable toner at the erasing temperature to erase the color of the erasable toner, to erase the image on the printed sheet P1.

The heating temperature by the heat roller 41 and the pressure belt 42 of the heating unit 32 is kept at a prescribed temperature by performing energization control of the halogen lamps 41*a*, 41*b* and the halogen lamp 43*a*. A heating temperature in the print mode is a fixing temperature. A heating temperature in the erasing mode is an erasing temperature higher than the fixing temperature. The heating unit 32 changes the erasing temperature at the time of the erasing mode based on whether the erasable toner used in the image of the printed sheet P1 is a genuine product or a non-genuine product. Specifically, the heating unit 32 changes the erasing temperature in the erasing mode based on the above-described detection result of the sensor 2. When the erasable toner used in the image on the printed sheet P1 is a genuine product, the heating unit 32 erases the image at a first erasing temperature. The first erasing temperature is an erasing temperature in accordance with the erasing characteristics of the erasing toner of a genuine product. When the erasable toner used in the image on the printed sheet P1 is a non-genuine product, the heating unit 32 erases the image at a second erasing temperature higher than the first erasing temperature. The heating unit 32 may use not a halogen lamp, but an IH (Induction Heating) coil, as a heating source. In addition, the structure of the heating unit 32 is not limited, but the pressure belt is changed to the pressure roller, and the nip may be formed between the heat roller and the pressure roller. In addition, when it is previously found that erasable toner of a non-genuine product can be erased at a temperature lower than that of erasable toner of a genuine product, the second erasing temperature may be made lower than the first erasing temperature.

The image forming apparatus 10 has a reading unit 37 in the conveying path 31 at a more downstream position than the heating unit 32 in the sheet conveying direction. In order to confirm whether or not the image has been erased by the heating unit 32, the reading unit 37 scans the sheet P1 after erasing processing, to read the image on the sheet P1. The image forming apparatus 10 has the re-conveying unit 34 provided at a position branched from the conveying path 31, and a pair of the sheet discharge rollers 33 provided at the dead end of the conveying path 31, as the conveying unit. In addition, the image forming apparatus 10 has the branch guide member 35*a* in the conveying path 31 at a position between the sheet discharge rollers 33 and the reading unit 37, as the conveying unit. In addition, the image forming apparatus 10 has the branch guide member 35*b* provided at a more downstream position than the sheet discharge rollers 33 in the sheet conveying direction, as the conveying unit. The re-conveying unit 34 inverts the sheet P, at the time of both-side printing in the print mode, in cooperation with the sheet discharge rollers 33 and the branch guide member 35*a*, and re-conveys the sheet P to the position of the resist rollers 31*a* of the conveying path 31. Specifically, the branch guide member 35*a* guides the sheet P which has passed through the heating unit 32 and the reading unit 37 to the sheet discharge rollers 33. The sheet discharge rollers 33 forward rotate, to discharge the sheet P partway to the sheet discharge tray 10*a*, and then the sheet discharge rollers 33 reversely rotate, to take in the sheet P inside the image forming apparatus 10 again. The branch guide member 35*a* guides the sheet P which has been taken in to the re-conveying unit 34. The re-conveying unit 34 re-conveys the sheet P to the position of the resist rollers 31*a* of the conveying path 31. In addition, when the re-conveying 34 performs the erasing processing again in the erasing mode, the re-conveying 34 re-conveys the sheet P to the position of the resist rollers 31*a* of the conveying path 31. Specifically, the branch guide member 35*a* guides the sheet P which has passed through the heating unit 32 and the reading unit 37 to the re-conveying unit 34. The re-conveying unit 34 re-conveys the sheet P to the position of the resist rollers 31*a* of the conveying path 31. The branch guide member 35*b* branches and guides the sheet discharged from a pair of the sheet discharge rollers 33 to the sheet discharge tray 10*a* or the reject tray 10*b*. The sheet discharge tray 10*a* collects the image printed sheet P in the print mode, and collects the reusable sheet P1 after erasing processing in the erasing mode. The reject tray 10*b* collects the image printed sheet P in the print mode, and collects the unreusable sheet P1 after erasing processing in the erasing mode. The branch guide member 35*a* and the branch guide member 35*b* rotate, to change the guide direction of the sheet.

With the above-described configuration, the image forming apparatus 10 forms an image on a sheet P using erasable toner in the printer unit 11 in the print mode, and discharges the sheet P to the sheet discharge tray 10*a* or the reject tray 10*b*. In addition, the image forming apparatus 10 controls the heating temperature of the heating unit 32 to the first erasing temperature or the second erasing temperature in the erasing mode, based on the detection result of the sensor 2, to erase an image of a printed sheet P1, and discharges the sheet P1 after erasing processing to the sheet discharge tray 10*a* or the reject tray 10*b*.

The image forming apparatus 10 of the first embodiment is not limited to a color MFP. The image forming apparatus 10 may be a monochrome MFP. In addition, the image forming apparatus may be a printer having only print function. In the image forming apparatus 10, the number of developing devices is not limited. Without using an intermediate transfer belt, the image forming apparatus 10 may directly transfer a toner image from the photoconductor drum 22 to a sheet P. The image forming apparatus 10 may be provided with a plurality of printer units. The image forming apparatus 10 is not limited to an apparatus to form an image with an electrophotographic system. For example, the image forming apparatus 10 may be an apparatus to form an image with an ink jet system.

Figure 4:
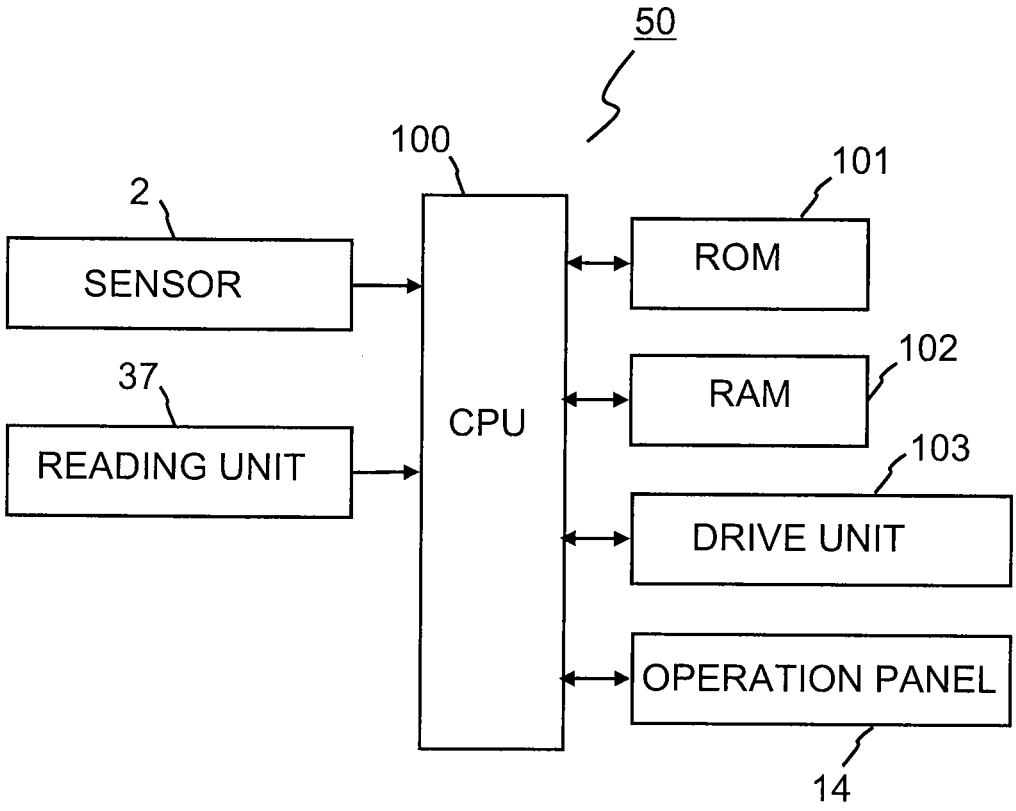
FIG. 4 is a block diagram showing a configuration of a control system which mainly aims at erasing temperature control of the image forming apparatus according to the first embodiment.

A configuration of a control system 50 of the image forming apparatus 10 which mainly aims at the erasing temperature control of the heating unit 32 will be described with reference to FIG. 4. FIG. 4 is a block diagram showing a configuration of a control system which mainly aims at the erasing temperature control of the image forming apparatus 10 according to the first embodiment. As shown in FIG. 4, the control system 50 has the CPU 100 that is a control unit to control the whole image forming apparatus 10, a ROM (Read Only Memory) 101 and a RAM (Random Access Memory) 102 that are a memory unit, a drive unit 103 to drive the heating unit and so on, the operation panel 14, the sensors 2 and the reading unit 37, for example.

The CPU 100 executes a program stored in the ROM 101 or the RAM 102, to put the processing function for image forming and image erasing into practice. The ROM 101 stores a control program to administer the fundamental operation of the image forming and image erasing processing, and control data and so on. The ROM 101 stores a temperature control program of the heating unit 32 in accordance with the detection result of the sensor 2, for example. The RAM 102 further stores control parameters, the number of prints, a printing time and so on.

Figure 5:
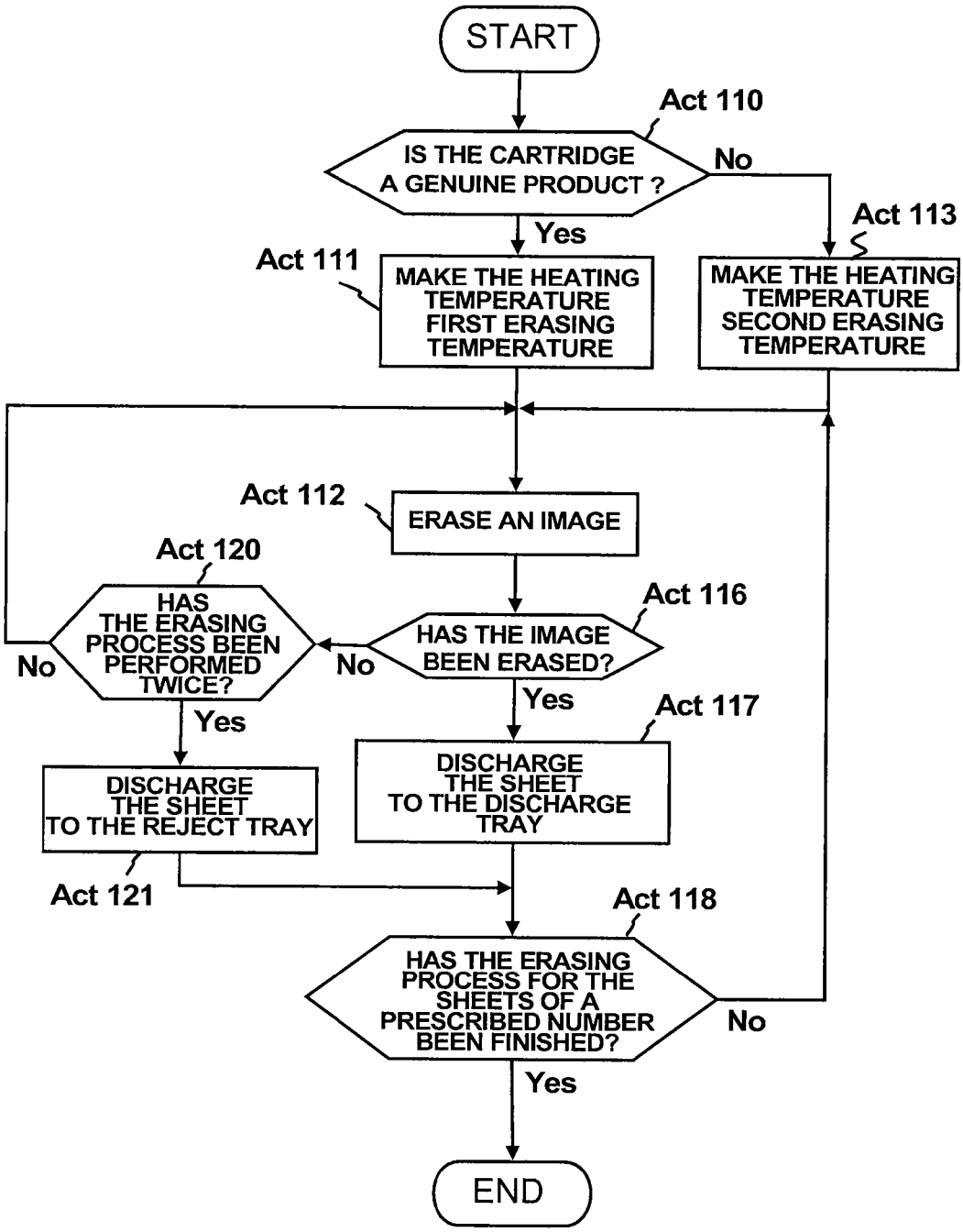
FIG. 5 is a flow chart showing erasing temperature control and an erasing operation of the image forming apparatus according to the first embodiment.

Erasing temperature control and erasing operation of the heating unit 32 will be described with reference to FIG. 5. FIG. 5 is a flow chart showing erasing temperature control and erasing operation of the image forming apparatus 10 of the first embodiment. A user houses a printed sheet P1 in the second sheet feeding cassette 16*b*, for example, so as to obtain a reusable sheet. The printed sheet P1 is a sheet on which an image has been printed by the image forming apparatus 10. The user further selects the second sheet feeding cassette 16*b* as the sheet housing portion, and instructs start of the erasing mode, from the operation panel 14. When the operation panel 14 accepts the selection of the sheet housing portion and the start instruction of the erasing mode, in an Act 110, the CPU 100 judges whether or not the cartridge 21 mounted on the image forming apparatus 10 is a genuine product, based on the detection result of the sensor 2, as described above. Specifically, when the cartridge is a genuine product, the sensor 2 detects the portion to be detected 25 of the cartridge 21, to read the authentication information D1. The CPU 100 judges whether or not the cartridge 21 mounted on the image forming apparatus 10 is a genuine product, based on the detection result of the sensor 2.

When the sensor 2 has read the authentication information D1 of the portion to be detected 25, the CPU 100 judges that the cartridge 21 is a genuine product. When the CPU judges that the cartridge 21 is a genuine product, as described above, the CPU 100 judges that the erasable toner used in the image of the printed sheet P1 is a genuine product. When the CPU judges that the erasable toner used in the image of the printed sheet P1 is a genuine product (Yes in the Act 110), the operation of the image forming apparatus 10 proceeds to an ACT 111. In the Act 111 (make the heating temperature the first erasing temperature), the CPU 100 performs energization control of the halogen lamps 41*a*, 41*b* and the halogen lamp 43*a* of the heating unit 32 so that the heating temperature of the heating unit 32 becomes the first erasing temperature.

When the sensor 2 can not read the authentication information D1 of the portion to be detected 25, the CPU 100 judges that the cartridge 21 is a non-genuine product. When the CPU judges that the cartridge 21 is a non-genuine product, as described above, the CPU 100 judges that the erasable toner used in the image of the printed sheet P1 is a non-genuine product. When the CPU judges that the erasable toner used in the image of the printed sheet P1 is a non-genuine product (No in the Act 110), the operation of the image forming apparatus 10 proceeds to an Act 113. In the Act 113 (make the heating temperature the second erasing temperature), the CPU 100 performs energization control of the halogen lamps 41*a*, 41*b* and the halogen lamp 43*a* of the heating unit 32 so that the heating temperature of the heating unit 32 becomes the second erasing temperature. After the operation of the above-described Act 111 or the above-described Act 113, the operation of the image forming apparatus 10 proceeds to an Act 112.

In the Act 112 (erase an image), the CPU 100 controls the drive unit 103. The second pickup roller 16*d* takes out the printed sheet P1 from the second sheet feeding cassette 16*b*. The resist rollers 31*a*, the intermediate transfer belt 18 and the secondary transfer roller 30 cooperatively convey the sheet P1 which has been taken out to the heating unit 32. Since the image forming apparatus is in the erasing mode, the secondary transfer roller 30 does not transfer the toner image on the sheet P1. When the CPU 100 judges that the erasable toner used in the image of the printed sheet P1 is a genuine product, since the heating unit 32 is controlled so that the heating temperature of the heating unit 32 becomes the first erasing temperature, the heating unit 32 heats the toner image of the printed sheet P1 at the first erasing temperature, to erase the image. When the CPU 100 judges that the erasable toner used in the image of the printed sheet P1 is a non-genuine product, since the heating unit 32 is controlled so that the heating temperature of the heating unit 32 becomes the second erasing temperature, the heating unit 32 heats the toner image of the printed sheet P1 at the second erasing temperature, to erase the image. In an Act 116 (has the image been erased?), the CPU 100 makes the reading unit 37 operate. The reading unit 37 scans the sheet P1 after erasing processing, to read the image of the sheet P1. The CPU 100 judges whether or not the image of the sheet P1 has been erased, based on the reading result of the reading unit 37.

When the CPU 100 judges that the toner image of the printed sheet P1 has been erased, based on the reading result of the reading unit 37 (Yes in the Act 116), the operation of the image forming apparatus 10 proceeds to an Act 117. In the Act 117 (discharge the sheet to the sheet discharge tray), the sheet discharge rollers 33 discharge the sheet P1 after erasing processing outside the image forming apparatus 10, and the branch guide member 35*b* guides the sheet P1 after erasing processing to the sheet discharge tray 10*a*. The sheet discharge tray 10*a* collects the sheet P1 after erasing processing, that is the reusable sheet P1. After the operation of the Act 117, the operation of the image forming apparatus 10 proceeds to an Act 118.

In the Act 118, the CPU 100 judges whether or not the erasing processing for the sheets P1 of a prescribed number has been finished. The above-described prescribed number of the sheets is the number of the sheets for erasing processing which a user has previously designated with the operation panel 14. When the operation panel 14 has accepted the user's designation of the number of sheets for erasing processing, the CPU 100 judges whether or not the erasing processing for the sheets P1 of the previously designated number has been finished, each time the erasing processing for one sheet P1 is finished. When the operation panel 14 does not accept the user's designation of the number of sheets for erasing processing, assuming that the prescribed number of the sheets is the number of the sheets P1 which the user has housed in the sheet feeding cassette 16*b*, the CPU 100 judges whether or not the erasing processing for the sheets P1 of the prescribed number has been finished. In other words, the CPU judges whether or not the sheet P exists in the second sheet feeding cassette 16*b*. When the CPU 100 judges that the erasing processing for the sheets P1 of the prescribed number has been finished (Yes in the Act 118), the erasing processing of the image forming apparatus 10 will be finished. In the above-described Act 118, when the CPU 100 judges that the erasing processing for the sheets P1 of the prescribed number has not been finished (No in the Act 118), the operation of the image forming apparatus 10 returns to the above-described Act 112. The image forming apparatus 10 takes out the next sheet P1 from the second sheet feeding cassette 16*b*, and repeats the erasing operation of the above-described Act 112 and later.

In the above-described Act 116, the CPU 100 judges that the image of the printed sheet P1 has not been erased, based on the reading result of the reading unit 37 (No, in the Act 116), the operation of the image forming apparatus 10 proceeds to an Act 120. In the Act 120, the CPU 100 judges whether or not the erasing processing for the same sheet P1 has been performed by a prescribed number of times, twice, for example. When the CPU 100 judges that the erasing processing has been performed twice (Yes in the Act 120), the operation of the image forming apparatus 10 proceeds to an Act 121. In the Act 121, the CPU 100 judges that the sheet P1 after erasing processing is an unreusable sheet. The sheet discharge rollers 33 discharge the unreusable sheet P1 outside the image forming apparatus 10. The branch guide member 35*b* guides the sheet P1 discharged by the sheet discharge rollers 33 to the reject tray 10*b*. The reject tray 10*b* collects the unreusable sheet P1. After the operation of the Act 121, the operation of the image forming apparatus 10 proceeds to the above-described Act 118.

When the CPU 100 judges that the erasing processing by the heating unit 32 has not been performed twice (No in the Act 120), the operation of the image forming apparatus 10 returns to the Act 112, so as to perform the erasing processing again. The CPU 100 makes the branch guide member 35*a* and re-conveying unit 34 to be operated. The branch guide member 35*a* guides the sheet P1 after first erasing processing to the re-conveying unit 34. The re-conveying unit 34 returns the sheet P1 to the position of the resist rollers 31*a*. The resist roller 31*a* conveys the sheet P1 again to the heating unit 32 in cooperation with the intermediate transfer belt 18 and the secondary transfer roller 30. In the above-described Act 112, the heating unit 32 performs the erasing processing to the sheet P1 again.

After the erasing processing of the printed sheet P1 has been performed again, the operation of the image forming apparatus 10 proceeds to the above-described Act 117 or the above-described Act 120, in accordance with the reading result of the reading unit 37 in the above-described Act 116. In the above-described Act 117, the sheet discharge tray 10*a* collects the reusable sheet P1. In the above-described Act 118, when the CPU 100 judges that the erasing processing for the sheets P1 of the prescribed number has entirely been finished (Yes in the Act 118), the image forming apparatus 10 finishes the erasing operation. In the above-described Act 118, when the CPU 100 judges that the erasing processing for the sheet P1 of the prescribed number has not been finished (No in the Act 118), the operation of the image forming apparatus 10 returns to the above-described Act 112. The image forming apparatus 10 takes out the next sheet P1 from the second sheet feeding cassette 16*b*, and repeats the erasing processing of the above-described Act 112 and later. In the above-described Act 120, when the CPU 100 judges that the erasing processing have been performed again (twice) to the same sheet P1 (Yes in the Act 120), in the above-described Act 121, the reject tray 10*b* collects the unreusable sheet P1. After the operation of the Act 121, the operation of the image forming apparatus 10 proceeds to the above-described Act 118.

As described above, the CPU 100 of the image forming apparatus 10 according to the first embodiment judges, in the erasing mode, whether the cartridge 21 mounted on the image forming apparatus 10 is a predetermined product, such as a genuine product, or a non-genuine product, based on the detection result of the authentication information D1 by the sensor 2. When the CPU 100 judges that the cartridge 21 mounted on the image forming apparatus 10 is a genuine product, the CPU 100 judges that the erasable toner that is erasable coloring material used in the image of the printed sheet P1 is a predetermined product, such as a genuine product. When the CPU 100 judges that the cartridge 21 mounted on the image forming apparatus 10 is a non-genuine product, the CPU 100 judges that the erasable toner used in the image of the printed sheet P1 is a non-genuine product. When the CPU 100 judges that the erasable toner used in the image of the printed sheet P1 is a genuine product, the CPU 100 controls the heating unit 32 so that the heating temperature of the heating unit 32 becomes the first erasing temperature. In addition, when the CPU 100 judges that the erasable toner used in the image of the printed sheet P1 is a non-genuine product, the CPU 100 controls the heating unit 32 so that the heating temperature of the heating unit 32 becomes the second erasing temperature higher than the first erasing temperature. In other words, the image forming apparatus 10 changes the erasing temperature of the heating unit 32 that is the erasing condition, in accordance with whether or not the erasable toner used in the printed sheet P1 is a genuine product. By changing the erasing temperature of the heating unit 32, the image of the printed sheet P1 is erased at an erasing temperature suited for the erasable toner of the genuine product or the erasable toner of the non-genuine product. Accordingly, according to the first embodiment, even if the erasable toner used in the printed sheet P1 is a genuine product or a non-genuine product, the image of the printed sheet P1 is surely erased. In addition, according to the first embodiment, since the heating temperature of the heating unit 32 is made an erasing temperature suited for the erasable toner used in the printed sheet P1, the saving of power consumption can be achieved.

Figure 7:
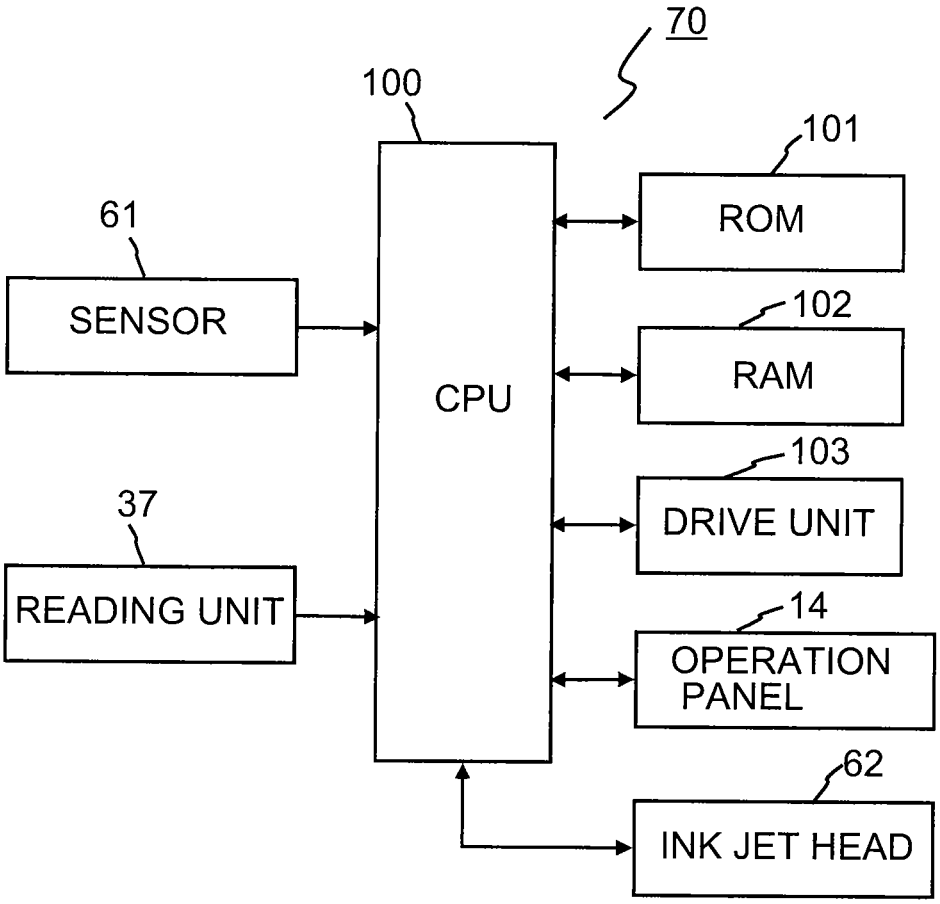
FIG. 7 is a block diagram showing a configuration of a control system which mainly aims at erasing temperature control of the image forming apparatus according to the second embodiment.
Figure 8:
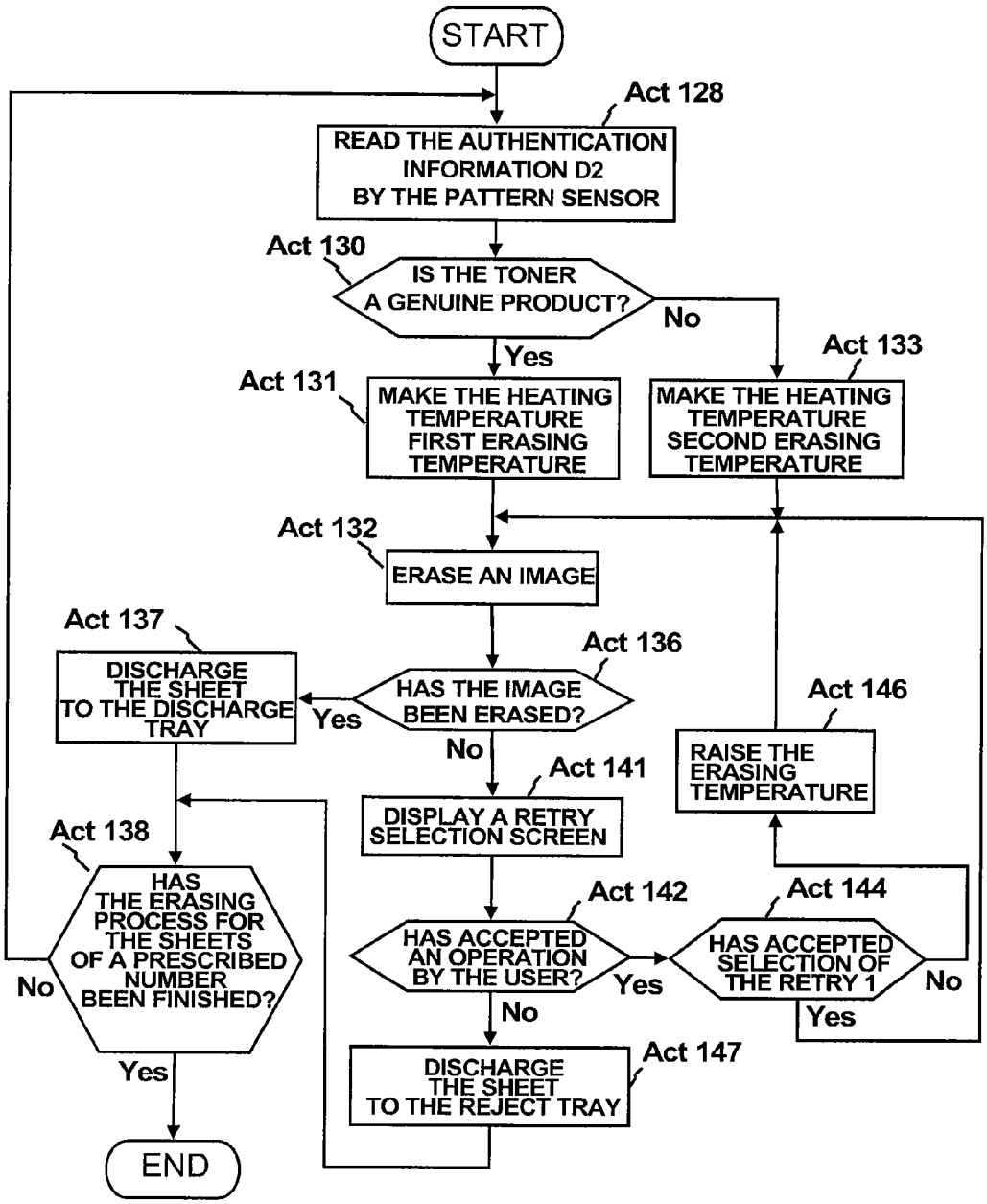
FIG. 8 is a flow chart showing erasing temperature control and an erasing operation of the image forming apparatus according to the second embodiment.

An image forming apparatus according to a second embodiment will be described with reference to FIG. 6 to FIG. 8. An image forming apparatus 60 according to a second embodiment is different from the first embodiment in a method of judging, and so on, whether erasable toner used in an image of a sheet P1 is a genuine product or a non-genuine product. In the image forming apparatus 60 of the second embodiment, the same symbols are given to the same configurations as those of the image forming apparatus 10 of the first embodiment, and accordingly the detailed description thereof will be omitted.

Figure 6:
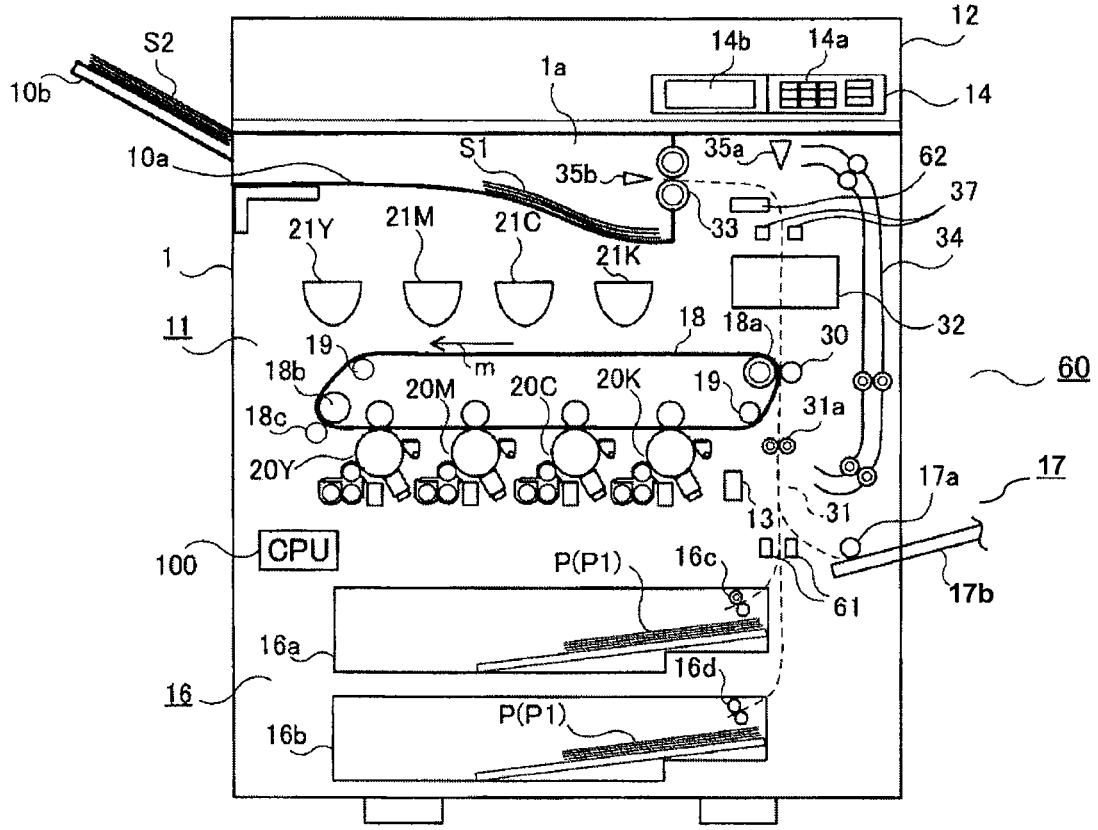
FIG. 6 is a sectional view showing an image forming apparatus according to a second embodiment.

FIG. 6 is a sectional view showing the image forming apparatus 60 according to the second embodiment. The image forming apparatus 60 according to the second embodiment has a sensor 61 provided at a more downstream position than the resist rollers 31*a* in the sheet conveying direction in the conveying path 31. The sensor 61 detects authentication information D2 which is printed along with an image on a printed sheet P1. The authentication information D2 is information which can authenticate whether or not the erasable toner used in the image of the printed sheet P1 is a predetermined product. Predetermined erasable toner is toner which is certified by the maker of the image forming apparatus 60. Hereinafter, the toner which is certified by the maker of the image forming apparatus 60 is called a genuine product, and toner other than a genuine product is called a non-genuine product. The authentication information D2 is information which is printed along with an image on a printed sheet P1, and includes information which can judge an image forming apparatus that has printed an image on a printed sheet P1. Specifically, the authentication information D2 includes information specific to an apparatus, such as a maker name, a type name of an image forming apparatus that has printed an image on a printed sheet P1. The authentication information D2 is printed on a printed sheet P1 as a specific pattern, for example. This specific pattern is printed on a sheet P1 using coloring material of a color which is hardly visible for a person, such as yellow (Y). The sensor 61 detects the above-described specific pattern of the printed sheet P1 which is conveyed on the conveying path 31 in the erasing mode. The CPU 100 of the image forming apparatus 60 identifies an apparatus which has printed the printed sheet P1, for example, based on the detection result of the sensor 61, and judges whether the erasable toner used in the image of the printed sheet P1 is a genuine product or a non-genuine product. In addition, the image forming apparatus 60 has an ink jet head 62 at a more downstream position than the heating unit 32 in the sheet conveying direction in the conveying path 31. The ink jet head 62, in the print mode of the image forming apparatus 60, prints the above-described specific pattern indicating the authentication information D2 on the printed sheet P1 passing through the heating unit 32 with ink of yellow (Y).

Specifically, the printer unit 11 of the image forming apparatus 60 transfers the erasable toner image on the sheet P in the print mode. The heating unit 32 heats the erasable toner image of the sheet P at the fixing temperature, to fix the image on the sheet P. The ink jet head 62 prints the above-described specific pattern indicating the authentication information D2 on the sheet P on which the image has been fixed. After having printed the above-described specific pattern, the image forming apparatus 60 discharges the sheet P to the sheet discharge tray 10*a*. Accordingly, the above-described specific pattern is printed along with the above-described erasable toner image on the printed sheet P1 by the image forming apparatus 60.

The authentication information D2 printed as the specific pattern by the image forming apparatus 60 includes the information specific to the apparatus, such as the apparatus maker name and the type name of the apparatus of the image forming apparatus 60 itself. Accordingly it is found that the sheet P1 printed by the image forming apparatus 60 is a sheet which has been printed by the image forming apparatus 60, from the above-described specific pattern indicating the authentication information D2.

In the erasing mode, the sensor 61 of the image forming apparatus 60 detects the above-described specific pattern, to read the authentication information D2. The CPU 100 judges whether or not the image forming apparatus which has printed the image of the printed sheet P1 is a specific image forming apparatus, based on the read authentication information D2. The specific image forming apparatus is the image forming apparatus 60, and an image forming apparatus which uses the same erasable toner of a genuine product as that of the image forming apparatus 60, for example. When the image forming apparatus which has printed the image of the printed sheet P1 is a specific image forming apparatus, it is highly likely that the erasable toner used in the image of the printed sheet P1 is toner of a genuine product for the above-described specific image forming apparatus. When the image forming apparatus which has printed the image of the printed sheet P1 is not a specific image forming apparatus, it is highly likely that the erasable toner used in the image of the printed sheet P1 is toner of a non-genuine product. Accordingly, when the image forming apparatus which has printed the image of the printed sheet P1 is a specific image forming apparatus, the CPU 100 judges that the erasable toner used in the image of the printed sheet P1 is a genuine product. When the image forming apparatus which has printed the image of the printed sheet P1 is not a specific image forming apparatus, the CPU 100 judges that the erasable toner used in the image of the printed sheet P1 is a non-genuine product. The CPU 100 controls the heating unit 32, so that the heating temperature of the heating unit 32 becomes the first erasing temperature or the second erasing temperature, in accordance with whether or not the erasable toner used in the image of the printed sheet p1 is a genuine product, to erase the image of the printed sheet P1. The image forming apparatus 60 discharges the sheet P1 after erasing processing to the sheet discharge tray 10*a* or the reject tray 10*b*.

A configuration of a control system 70 of the image forming apparatus 60 which mainly aims at the erasing temperature control of the heating unit 32 of the image forming apparatus 60 will be described with reference to FIG. 7. FIG. 7 is a block diagram showing a configuration of the control system 70 which mainly aims at the erasing temperature control of the image forming apparatus 60 according to the second embodiment. As shown in FIG. 7, the control system 70 has the CPU 100 that is a control unit to control the whole image forming apparatus 60, the ROM 101 and the RAM 102 that are a memory unit, the drive unit 103 to drive the heating unit and so on, the operation panel 14, the ink jet head 62, the sensor 61 and the reading unit 37. The ROM 101 stores a temperature control program of the heating unit 32 in accordance with the detection result from the pattern sensor 61, for example.

Erasing temperature control and erasing operation of the heating unit 32 in the image forming apparatus 60 will be described with reference to FIG. 8. FIG. 8 is a flow chart showing erasing temperature control and erasing operation of the image forming apparatus 60 of the second embodiment. A user houses a printed sheet P1 in the second sheet feeding cassette 16*b*, for example, so as to obtain a reusable sheet. The user further selects the second sheet feeding cassette 16*b* as the sheet housing portion, and instructs start of the erasing mode, from the operation panel 14. When the operation panel 14 accepts the selection of the sheet housing portion and the start instruction of the erasing mode, the pickup roller 16*d* takes out the printed sheet P1 from the second sheet feeding cassette 16*b*. The resist rollers 31 convey the printed sheet P1 to the heating unit 32 in cooperation with the intermediate transfer belt 18 and the secondary transfer roller 30. In an Act 128, the pattern sensor 61 detects the above-described specific pattern indicating the authentication information D2 of the sheet P1 conveyed on the conveying path 31, to read the authentication information D2.

When the pattern sensor 61 detects the above-described specific pattern indicating the authentication information D2, in an Act 130, the CPU 100 judges whether or not the erasable tonner used in the image of the printed sheet P1 is a genuine product, based on the detection result of the pattern sensor 61, as described above. When the CPU 100 judges that the erasable toner used in the image of the printed sheet is a genuine product (Yes in the Act 130), the operation of the image forming apparatus 60 proceeds to an Act 131. In the Act 131, the CPU 100 controls the heating unit 32 so that the heating temperature of the heating unit 32 becomes the first temperature. After the operation of the Act 131, the operation of the image forming apparatus 60 proceeds to an Act 132. When the CPU 100 judges that the erasable toner used in the image of the printed sheet is a non-genuine product (No in the Act 130), the operation of the image forming apparatus 60 proceeds to an Act 133.

In the Act 133, the CPU 100 controls the heating unit 32 so that the heating temperature of the heating unit 32 becomes the second erasing temperature. After the operation of the Act 133, the operation of the image forming apparatus 60 proceeds to the Act 132. In the Act 132, the heating unit 32 heats the image of the printed sheet P1 at the first erasing temperature or the second erasing temperature, to erase the image. After the erasing processing in the Act 132, in an Act 136 (has the image been erased?), the CPU 100 makes the reading unit 37 to be operated. The reading unit 37 scans the sheet P1 after erasing processing, to read the image of the sheet P1. The CPU 100 judges whether or not the image of the sheet P1 has been erased, based on the reading result of the reading unit 37.

When the CPU 100 judges that the image of the printed sheet P1 has been erased, based on the reading result of the reading unit 37 (Yes in the Act 136), the operation of the image forming apparatus 60 proceeds to an Act 137. In the Act 137 (discharge the sheet to the sheet discharge tray), the sheet discharge rollers 33 discharge the sheet P1 after erasing processing outside the image forming apparatus 60, and the branch guide member 35*b* guides the sheet P1 after erasing processing to the sheet discharge tray 10*a*. The sheet discharge tray 10*a* collects the sheet P1 after erasing processing, that is, the reusable sheet P1. After the operation of the above-described Act 137, the operation of the image forming apparatus 60 proceeds to an Act 138.

In the Act 138, the CPU 100 judges whether or not the erasing processing for sheets P1 of the prescribed number has been finished. The above-described prescribed number of the sheets is the number of the sheets for erasing processing which a user has previously designated from the operation panel 14, for example. When the operation panel 14 previously accepts the user's designation of the number of the sheets for erasing processing, the CPU 100 judges whether or not the erasing processing for the sheets P1 of the previously designated number is finished, each time the erasing processing for one sheet P1 is finished. When the operation panel 14 does not accept the user's designation of the number of sheets for erasing processing, assuming that the above-described prescribed number of the sheets is the number of sheets P1 which a user has housed in the sheet feeding cassette 16*b*, the CPU 100 judges whether or not the erasing processing for the sheets P1 of the prescribed number is finished. In other words, the CPU 100 judges whether or not the sheet P1 exists in the second sheet feeding cassette 16*b*. When the CPU 100 judges that the erasing processing for the sheets P1 of the prescribed number has been finished (Yes in the Act 138), the operation of the image forming apparatus 60 is finished. When the CPU 100 judges that the erasing processing for sheets P1 of the prescribed number has not been finished (No in the Act 138), the operation of the image forming apparatus 60 returns to the above-described Act 132. The image forming apparatus 60 takes out the next sheet P1 from the second sheet feeding cassette 16*b*, and repeats the erasing operation of the above-described Act 132 and later.

In the above-described Act 136, when the CPU 100 judges that the image of the printed sheet P1 has not been erased, based on the reading result of the reading unit 37 (No in the Act 136), the operation of the image forming apparatus 60 proceeds to an Act 141. In the Act 141, the CPU 100 controls the display 14*b* of the operation panel 14. The display 14*b* displays that the image of the printed sheet P1 can not be erased. In addition, the display 14*b* displays a retry selection screen which urges selection of any one out of, performing the erasing processing again without changing the erasing temperature that is the erasing condition, or performing the erasing processing again at a raised erasing temperature. Hereinafter, it is called a retry 1 to perform the erasing processing again without changing the erasing temperature that is the erasing condition, and it is called a retry 2 to perform the erasing processing again at the raised erasing temperature. A user can select the retry 1 or the retry 2, by touch operation of the retry selection screen of the display 14*b*.

In an Act 142, the CPU 100 waits for a prescribed time until the retry selection screen of the display 14*b* accepts the touch operation of the user. When the CPU 100 judges that the retry selection screen of the display 14*b* has accepted the user's touch operation within the prescribed time (Yes in the Act 142), the operation of the image forming apparatus 60 proceeds to an Act 144. In the Act 144, the CPU 100 judges whether the retry selection screen of the display 14*b* has accepted the selection of the retry 1 or has accepted the selection of the retry 2. When the CPU 100 judges that the retry selection screen has accepted the selection of the retry 1, the operation of the image forming apparatus 60 returns to the above-described Act 132. In the above-described Act 132, the CPU 100 makes the branch guide member 35*a* and the re-conveying unit 34 to be operated. The branch guide member 35*a* guides the sheet P1 after first erasing processing to the re-conveying unit 34. The re-conveying unit 34 returns the sheet P1 to the position of the resist rollers 31*a*. The resist rollers 31*a* convey the sheet P1 to the heating unit 32 again, in cooperation with the intermediate transfer belt 18 and the secondary transfer roller 30. In the above-described Act 132, the heating unit 32 performs the erasing processing to the sheet P1 again, without changing the erasing temperature that is the erasing condition.

In the above-described Act 144, when the CPU 100 judges that the retry selection screen has accepted the selection of the retry 2 (No in the Act 144), the operation of the image forming apparatus 60 proceeds to an Act 146. In the Act 146, the CPU 100 controls the heating unit 32 so as to raise the erasing temperature of the heating unit 32. For example, in the above-described Act 131, when the heating unit has been controlled so that the heating temperature of the heating unit 32 becomes the first erasing temperature, the CPU 100 controls the heating unit so that the heating temperature of the heating unit 32 becomes an erasing temperature that is higher than the first erasing temperature. For example, in the above-described Act 133, when the heating unit has been controlled so that the heating temperature of the heating unit 32 becomes the second erasing temperature, the CPU 100 controls the heating unit so that the heating temperature of the heating unit 32 becomes an erasing temperature that is higher than the second erasing temperature. After the operation of the above-described Act 133, the operation of the image forming apparatus 60 returns to the above-described Act 132. In the above-described Act 132, the CPU 100 makes the branch guide member 35*a* and the re-conveying unit 34 to be operated. The branch guide member 35*a* guides the sheet P1 after first erasing processing to the re-conveying unit 34. The re-conveying unit 34 returns the sheet P1 to the position of the resist rollers 31*a*. The resist rollers 31*a* convey the sheet P1 to the heating unit 32 again, in cooperation with the intermediate transfer belt 18 and the secondary transfer roller 30. In the above-described Act 132, the heating unit 32 raises the erasing temperature that is the erasing condition, and performs the erasing processing to the sheet P1 again.

In the above-described Act 142, when the CPU 100 judges that the retry selection screen of the display 14*b* has not accepted a user's touch operation after a prescribed time passes (No in the Act 142), the operation of the image forming apparatus 60 proceeds to an Act 147. In the Act 147, the CPU 100 judges that the sheet P1 after first erasing processing is an unreusable sheet. The sheet discharge rollers 33 discharge the unreusable sheet P1 outside the image forming apparatus 60. The branch guide member 35*b* guides the sheet P1 discharged by the sheet discharge rollers 33 to the reject tray 10*b*. The reject tray 10*b* collects the unreusable sheet P1. After the operation of the Act 147, the operation of the image forming apparatus 60 proceeds to the above-described Act 138.

As described above, the CPU 100 of the image forming apparatus 60 according to the second embodiment judges, in the erasing mode, whether or not an image forming apparatus which has printed the image on the printed sheet P1 is a specific image forming apparatus, such as the image forming apparatus 60 itself, based on the detection result of the authentication information D2 by the sensor 61. When the CPU 100 judges that the image forming apparatus which has printed the image on the printed sheet P1 is the image forming apparatus 60 itself, the CPU 100 judges that the erasable toner that is erasable coloring material used in the image of the printed sheet P1 is a predetermined product, that is a genuine product, for example. When the CPU 100 judges that the image forming apparatus which has printed the image on the printed sheet P1 is an image forming apparatus except the specific image forming apparatus, the CPU 100 judges that the erasable toner used in the image of the printed sheet P1 is a non-genuine product. When the CPU 100 judges that the erasable toner used in the image of the printed sheet P1 is a genuine product, the CPU 100 controls the heating unit 32 so that the heating temperature of the heating unit 32 that is the heating condition becomes the first erasing temperature. In addition, when the CPU 100 judges that the erasable toner used in the image of the printed sheet P1 is a non-genuine product, the CPU 100 controls the heating unit 32 so that the heating temperature of the heating unit 32 becomes the second erasing temperature higher than the first erasing temperature. In other words, the image forming apparatus 60 changes the erasing temperature of the heating unit 32, in accordance with whether or not the erasable toner used in the printed sheet P1 is a genuine product. By changing the erasing temperature of the heating unit 32, the image forming apparatus 60 erases the image of the printed sheet P1 at an erasing temperature suited for the erasable toner of the genuine product or the erasable toner of the non-genuine product. Accordingly, according to the second embodiment, even if the erasable toner used in the printed sheet P1 is a genuine product or a non-genuine product, the image of the printed sheet P1 is surely erased. In addition, according to the second embodiment, since the heating temperature of the heating unit 32 is made an erasing temperature suited for the erasable toner used in the printed sheet P1, the saving of power consumption can be achieved.

According to the second embodiment, when the image is not erased by the erasing processing, the retry selection screen in which whether or not the erasing processing is performed again, and whether or not the erasing processing is performed again by changing the erasing temperature can be selected, is displayed on the display 14*b*. Accordingly, according to the second embodiment, since a user can select the correspondence when the image has not been erased, the user can obtain a reusable sheet which meets the user's request.

According to the embodiments described above, no matter whether erasable toner used in an image of a printed sheet is a genuine product or a non-genuine product, the image is erased at an erasing temperature suited for the erasing characteristics of the toner. Accordingly, even if the erasable toner is a genuine product or a non-genuine product, the image can be surely erased, and the saving of power consumption can be achieved.

The image forming apparatus of the embodiments described above judges whether or not erasable toner used in an image of a printed sheet is a genuine product or a non-genuine product, based on the detection result of whether or not a cartridge mounted on the image forming apparatus is a predetermined product, that is a genuine product, for example, or the detection result of whether or not an image forming apparatus which has printed an image of a printed sheet is a specific image forming apparatus, that is the own image forming apparatus, for example. But a judging method of whether erasable toner used in an image of a printed sheet is a genuine product or a non-genuine product is not limited to the judging method of the above-described embodiments. For example, whether or not erasable coloring material used in an image of a printed sheet is a predetermined product may be judged, based on reflected light which is obtained by irradiating light to the image of the printed sheet.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus having an image forming function to form an image on a recording medium, and an image erasing function to erase an image formed on a recording medium, the image forming apparatus comprising:

an image forming unit configured to form the image on the recording medium using erasable coloring material, when the image forming function is performed; and an erasing unit configured to erase the image formed on the recording medium under an erasing condition changeable in accordance with whether or not erasable coloring material used in the image formed on the recording medium is predetermined coloring material, when the image erasing function is performed.

2. The image forming apparatus according to claim 1, wherein the erasing unit includes a heating unit which heats the image formed on the recording medium at a fixing temperature, to fix the image on the recording medium, when the image forming function is performed, and heats the image formed on the recording medium at a first erasing temperature that is the erasing condition or at a second erasing temperature higher than the first erasing temperature, to erase the image formed on the recording medium, when the image erasing function is performed.

3. The image forming apparatus according to claim 2, further comprising a sensor configured to obtain information for judging whether or not the erasable coloring material used in the image formed on the recording medium is the predetermined coloring material, when the image erasing function is performed.

4. The image forming apparatus according to claim 3, further comprising a control unit configured to judge whether or not the erasable coloring material used in the image formed on the recording medium is the predetermined coloring material, based on the information obtained by the sensor, to control the heating unit so that a heating temperature of the heating unit becomes the first erasing temperature when judges that the erasable coloring material is the predetermined coloring material and to control the heating unit so that the heating temperature of the heating unit becomes the second erasing temperature when judges that the erasable coloring material is not the predetermined coloring material.

5. The image forming apparatus according to claim 4, further comprising a reading unit configured to read the image of the recording medium after erasing process by the erasing unit, wherein the control unit judges whether or not the image of the recording medium has been erased, based on a reading result of the reading unit, and when the control unit judges that the image of the recording medium has not been erased, the control unit controls the erasing unit so as to perform erasing processing again.

6. The image forming apparatus according to claim 5, wherein the control unit controls the erasing unit so as to change an erasing temperature that is the erasing condition and perform the erasing processing again when the control unit judges that the image of the recording medium has not been erased.

7. The image forming apparatus according to claim 6, wherein the control unit controls the erasing unit so as to change the erasing temperature that is the erasing condition to a higher temperature and perform the erasing processing again when the control unit judges that the image of the recording medium has not been erased.

8. The image forming apparatus according to claim 7, further comprising an operation panel configured to accept selection of whether or not to perform the erasing processing again, when the control unit judges that the image of the recording medium has not been erased; wherein when the operation panel accepts the selection of performing the erasing processing again, the control unit controls the erasing unit so as to perform the erasing processing again.

9. The image forming apparatus according to claim 8, wherein the image forming unit has a cartridge which is detachably mounted on the image forming apparatus and houses the erasable coloring material, and the sensor detects that the cartridge is a predetermined cartridge.

10. The image forming apparatus according to claim 8, wherein the sensor detects information relating to an apparatus that has formed the image from the recording medium on which the image has been formed.

* * * * *